US005247333A

United States Patent [19]

Yamamoto et al.

[11] Patent Number: 5,247,333

[45] Date of Patent: Sep. 21, 1993

[54] ONE-COMPONENT DEVELOPING APPARATUS

[75] Inventors: Mikio Yamamoto; Hidekiyo Tachibana; Masashi Kajimoto; Yutaka Toyoda; Jun Abe; Masaaki Fukuhara; Shigeru Inaba; Tetsuya Fujita, all of Kanagawa, Japan

[73] Assignee: Fuji Xerox Co., Ltd., Tokyo, Japan

[21] Appl. No.: 885,883

[22] Filed: May 20, 1992

[30] Foreign Application Priority Data

May 21, 1991 [JP] Japan ..... 3-144227
Oct. 9, 1991 [JP] Japan ..... 3-289395

[51] Int. Cl.[5] ..... G03G 15/06

[52] U.S. Cl. ..... 355/245; 355/259; 355/260; 118/661

[58] Field of Search ..... 355/245, 246, 259, 260, 355/251, 253, 261, 262, 263, 265; 118/661, 656, 653, 657, 652, 647, 648, 649, 650

[56] References Cited

U.S. PATENT DOCUMENTS

| | | | |
|---|---|---|---|
| 4,050,413 | 9/1977 | Parker | 118/658 |
| 4,266,503 | 5/1981 | Uehara et al. | 118/657 |
| 4,714,046 | 12/1987 | Steele et al. | 118/657 |
| 4,733,267 | 3/1988 | Enoki et al. | 355/253 |
| 4,745,429 | 5/1988 | Mukai et al. | 355/259 X |

FOREIGN PATENT DOCUMENTS

| | | | |
|---|---|---|---|
| 0123573 | 9/1981 | Japan | 355/253 |
| 0123574 | 9/1981 | Japan | 355/253 |
| 0113081 | 5/1986 | Japan | 355/251 |
| 0094873 | 5/1987 | Japan | 355/260 |
| 62-251771 | 11/1987 | Japan . | |
| 0018375 | 1/1988 | Japan | 355/245 |
| 1-49945 | 10/1989 | Japan . | |
| 0282766 | 11/1990 | Japan | 355/245 |
| 0282767 | 11/1990 | Japan | 355/245 |
| 0180876 | 8/1991 | Japan | 355/245 |
| 2186818 | 8/1987 | United Kingdom | 355/253 |

*Primary Examiner*—A. T. Grimley
*Assistant Examiner*—Matthew S. Smith
*Attorney, Agent, or Firm*—Finnegan, Henderson, Farabow, Garrett & Dunner

[57] ABSTRACT

Disclosed is a one-component developing apparatus in which a developing agent scale-off member such as a wire member is provided parallel to the surface of the developing agent carrier so as to be in contact with or in close proximity to a developing agent carrier. A developing agent thin layer formed on the surface of the developing agent carrier which did not contribute to development in a development region comes into contact with the developing agent scale-off member so as to be forcibly scaled off of the developing agent carrier, so that the image history is erased. When the developing agent scale-off member is made to vibrate, or a bias voltage is applied between the developing agent scale-off member and the developing agent carrier, the developing agent may be scaled off more efficiently.

14 Claims, 7 Drawing Sheets

ONE-COMPONENT DEVELOPING APPARATUS

BACKGROUND OF THE INVENTION

The present invention generally relates to a developing apparatus for use in image forming equipment such as an eletrophotographic copying machine, a printer, or the like, in which a developing agent is made to adhere onto an electrostatic latent image so as to visualize the image, and particularly relates to a one-component developing apparatus in which a one-component developing agent is transferred in a vibratory electric field generated between an electrostatic latent image holder and a developing agent carrier to thereby develop an electrostatic latent image.

Conventionally, a developing apparatus for visualizing an electrostatic latent image with a one-component developing agent has been realized by an apparatus in which a developing agent carrier is disposed in opposition to an electrostatic latent image holder, and a developing agent restriction member and a developing agent feed portion are provided in the surrounding of the developing agent carrier.

In such a developing apparatus, a developing agent stored in a hopper or the like is supplied from a developing agent feed portion to a developing agent carrier. The developing agent carrier is arranged so as to carry the developing agent which is made to adhere on the surface of the developing agent carrier. Further, a developing agent restriction member is provided so as to be in contact with the developing agent carrier by predetermined pressure, and the developing agent adhering on the developing agent carrier surface is restricted by the developing agent restriction member so as to be formed into a uniform thin layer, the thin layer being given desired charges. Then, the developing agent is carried to a position opposite to an electrostatic latent image holder and transferred to the electrostatic latent image holder by a vibratory electric field generated between the electrostatic latent image holder and the developing agent carrier to develop an electrostatic latent image on the electrostatic latent image holder.

In such a one-component developing apparatus, however, an image history in the thin developing agent layer formed on the surface of the developing agent carrier becomes a problem. Next, this problem will be described.

A developing agent thin layer which has been carried in the state where it adheres on the surface of the developing agent carrier contributes, in the position opposite to an electrostatic latent image holder, to development in accordance with an electrostatic latent image. At this time, however, a portion where the developing agent is consumed (a development portion) and a portion where the developing agent is not consumed are generated. In the development portion, when a developing agent carrier circulates through a developing agent feed portion, a new developing agent is fed so that a new thin developing agent layer is formed by a developing agent restriction member. In the non-development portion, on the contrary, the thin developing agent layer which has been formed passes by the developing agent restriction member again, so that the same thin developing agent layer passes by the developing agent restriction member several times if no developing agent is newly applied to a non-image portion. At this time, if the layer thickness of the developing agent on the developing agent carrier is measured, it is found that the layer thickness of the new developing agent in the development portion is thicker by several μm than the layer thickness of that in the non-development portion, and the quantity of charges of the developing agent in the development portion is lower by about several C/g than that in the non-development portion. Further, adhesive force of the developing agent to the developing agent carrier in the non-development portion is larger than that in the development portion so that there occurs a difference in transfer properties of the developing agent between the non-development and development portions. These factors cause a difference in development concentration so that a fault called a ghost due to an image history appears.

For example, as shown in FIG. 7A, development is made on an image having a rectangular solid black portion 42 with long sides in the image forming direction in a range from an image forming initiation end 41*a* of an A4-size original 41 to a position of about $\frac{2}{3}$ of the length of the original 41, and having a meshed portion 43 occupying approximately 50% of the residual portion of the remaining $\frac{1}{3}$ of the foregoing area. In the thus formed image, as shown in FIG. 7B, a portion 143*a* of the meshed portion 143 following the rectangular solid black portion 142 in the image forming direction has higher image concentration than that of a portion 143*b* of the meshed portion 143 following a portion other than the solid black portion 142. This is because a developing agent on the developing agent carrier in the solid black portion, that is, in the development portion, transfers more easily than in the non-development portion, and because the quantity of charges of the developing agent in the development portion is slightly smaller than that in the non-development portion. Therefore, the quantity of developing agent for neutralizing the latent image charge of a meshed image is larger than that in the non-image portion.

A developing apparatus having means for solving the foregoing problems is disclosed, for example, in Japanese Patent Publication No. Hei-1-49945, and in Japanese Patent Unexamined Publication No. Sho-62-251771.

In the developing apparatus disclosed in Japanese Patent Publication No. Hei-1-49945, as shown in FIG. 8, a developing agent which does not contribute to development and remains on the surface of a developing agent carrier 1 is removed from the developing agent carrier 1 by a roller 107 rotating in close proximity to the developing agent carrier 1 and being supplied with a voltage for attracting the developing agent. After being transferred onto the roller 107, the removed developing agent is directly returned onto the surface of the developing agent carrier 1. In the apparatus, the image history is erased by disturbance generated when a developing agent is removed from the surface of the developing agent carrier and returned thereto again.

In the developing apparatus disclosed in Japanese patent unexamined Publication No. Sho-62-251771, there is provided a scale-off member 207 constituted by a plate-like blade contacting at its front end with the surface of a developing agent carrier 1 as shown in FIG. 9. The image history is erased by scaling off a developing agent which did not contribute to development and remains on the surface of the developing agent carrier 1.

The foregoing conventional developing apparatuses, however, have the following problems.

In the developing apparatus disclosed in Japanese Patent Publication No. Hei-1-49945, the roller 107 is provided so as to rotate in close proximity to the developing agent carrier 1, and it is therefore necessary to provide a space for disposing the roller 107.

Further, it is necessary to provide means for driving the roller 107 to rotate, means for application of a bias voltage, a blade means for returning a developing agent on the roller 107 to the developing agent carrier 1, and the like. Therefore, the developing apparatus increases in size and the mechanism is complicated, thereby increasing the cost for manufacturing.

In the developing apparatus disclosed in Japanese Patent Unexamined Publication No. Sho-62-251771, on the other hand, the scale-off means 207 is urged against the surface of the developing agent carrier 1 and a developing agent is therefore deteriorated because it is used for a long time.

Further, frictional force between the scale-off member 207 and the surface of the developing agent carrier 1 is a large load for rotational driving of the developing agent carrier 1 because the scale-off member is urged against the developing agent carrier 1, and it is therefore necessary to increase the force for rotating the developing agent carrier 1.

SUMMARY OF THE INVENTION

In view of the foregoing problems in the related art, it is an object of the present invention to provide a one-component developing apparatus which is not increased in size to thereby make it possible to be manufactured at a low cost and in which deterioration of a developing agent and generation of an image fault due to an image history can be prevented.

In order to solve the foregoing problems, according to an aspect of the present invention, the one-component developing apparatus comprises a developing agent carrier disposed in opposition to an electrostatic latent image holder so as to carry a one-component developing agent adhering on a surface of the developing agent carrier, a developing agent feed portion for feeding the developing agent carrier with the developing agent, and a developing agent restriction member for restricting the developing agent adhering on the surface of the developing agent carrier so as to form a thin layer of the developing agent, whereby the developing agent on the surface of the developing agent carrier is transferred in a vibratory electric field generated by application of an AC bias voltage between the developing agent carrier and the electrostatic latent image holder to thereby develop an electrostatic latent image on the electrostatic latent image holder, wherein the apparatus further comprises a developing agent scale-off member constituted by at least one wire member provided in parallel to the surface of the developing agent carrier so that the wire member is in contact with the surface of the developing agent carrier or the wire member has a distance so as to be able to contact with the thin layer of the developing agent, in a region where the developing agent carrier is in close proximity to the electrostatic latent image holder and a position where the developing agent feed portion is provided in the advancing direction of the surface of the developing agent carrier.

Preferably, in the above one-component developing apparatus, the wire member constituting the developing agent scale-off member is made of a conductive material.

Preferably, in the above one-component developing apparatus, a bias voltage is applied between the wire member constituting the developing agent scale-off member and the developing agent carrier.

According to another aspect of the present invention, the one-component developing apparatus comprises a developing agent carrier disposed in opposition to an electrostatic latent image holder so as to carry a one-component developing agent adhering on a surface of the developing agent carrier, a developing agent feed portion for feeding the developing agent carrier with the developing agent, and a developing agent restriction member for restricting the developing agent adhering on the surface of the developing agent carrier so as to form a thin layer of the developing agent, whereby the developing agent on the surface of the developing agent carrier is transferred in a vibratory electric field generated by application of an AC bias voltage between the developing agent carrier and the electrostatic latent image holder to thereby develop an electrostatic latent image on the electrostatic latent image holder, wherein the apparatus further comprises a developing agent scale-off member constituted by a film-like member having a plurality of holes and being provided in parallel to the surface of the developing agent carrier so that the film-like member is in contact with the surface of the developing agent carrier or the film-like member has a distance so as to be able to contact the thin layer of the developing agent, in a region from a position where the developing agent carrier is in close proximity to the electrostatic latent image holder and a position where the developing agent feed portion is provided in the advancing direction of the surface of the developing agent carrier.

Preferably, in the above one-component developing apparatus according to the other aspect of the present invention, the developing agent scale-off member is constituted by a conductive member and a bias voltage is applied between the conductive member and the developing agent carrier.

In the above one-component developing apparatus according to the one and the other aspect of the present invention, the foregoing "distance so as to be able to contact the thin layer of the developing agent", which is the distance between the developing agent scale-off member and the surface of the developing agent carrier, can be a distance not larger than the thickness of the developing agent thin layer when no means for making the developing agent scale-off member vibrate is provided, and, on the contrary, a distance in which the vibrating developing agent scale-off member can come into contact with the developing agent thin layer by its own vibration where there is provided means for making the developing agent scale-off member vibrate.

In the above one-component developing apparatus according to the one aspect of the present invention, the wire member may have any one of various sections such as a circular section, a triangle section, a rectangular section, and the like.

In the above one-component developing apparatus according to the one aspect of the present invention, copper, tungsten, stainless steel, or the like may be used as the conductive material to be employed as the wire member, and the conductive material may be suitably selected from materials in which a dielectric potential is generated.

Further, it is desirable that the wire member has an insulating layer covering its surface. As the insulating layer, not only an enamel coating film, a glass coating, or the like, may be used, but any other insulating coating may be employed. In the above one-component developing apparatus according to the one and the other aspect of the present invention, a DC bias voltage or an AC bias voltage may be used as the bias voltage to be applied between the wire member and the developing agent carrier, and the bias voltage may be defined as a voltage for generating an electric field for promoting scale-off of a developing agent adhering on the surface of the developing agent carrier.

In the above one-component developing apparatus according to the other aspect of the present invention, the film member having a plurality of holes may be a thin plate-like member having numbers of holes formed by punching, or a mesh-like member formed of a plurality of wire materials intertwined with each other. At this time, it is desirable that the holes are provided substantially equidistantly in the axial direction of the developing agent carrier.

In the above one-component developing apparatus according to the one aspect of the present invention, the wire member is provided so as to be in contact with or to be in close proximity to the surface of the developing agent carrier in the position following the developing region in the progressing direction of the developing agent carrier. Therefore, a developing agent thin layer remaining on the surface of the developing agent carrier comes into contact with the wire member so that it is compulsively scaled off from the surface of the developing agent carrier.

When the developing agent is scaled off from the surface of the developing agent carrier, a new developing agent is fed from the developing agent feed portion to the developing agent-scaled portion so that a developing agent thin layer having the same quantity of charges and the same layer thickness as those in the portion (the development portion) where the developing agent has been consumed in the preceding development is formed. As a result, the developing agent thin layer is made uniform to thereby erase the image history so that a satisfactory image is obtained even when development is continuously performed.

In the above one-component developing apparatus according to the one aspect of the present invention, preferably, the wire member provided in parallel to the surface of the developing agent carrier so as to be in contact with or in close proximity to the surface of the developing agent carrier is made of a conductive material. Therefore, a dielectric potential may be generated in the section of the wire member by an AC bias voltage applied to the developing agent carrier. No dielectric potential is generated in the wire member when the wire member is not in contact with the surface of the developing agent carrier so as not to be in the electrically conductive state. However, because the developing agent carrier is made of a high resistivity material and an insulating developing agent exists on the surface of the developing agent carrier, the electric resistance between the wire member and the developing agent carrier increases so that the dielectric potential is generated in the section of the wire member, and attractive force due to the dielectric potential acts between the surface of the developing agent carrier and the wire member. Since an AC voltage is applied to the developing agent carrier, however, the attraction force changes into repulsive force when the polarity is inverted. At the same time, a new dielectric potential is generated so that the repulsion force changes into attractive force. Thus, self-vibration in the direction of the normal line of the surface of the developing agent carrier is caused in the wire member in accordance with the frequency of the AC bias electric potential applied to the developing agent carrier.

The vibration makes the wire member come into contact with a developing agent on the surface of the developing agent carrier to mechanically disturb the developing agent so that the developing agent on the surface of the developing agent carrier can be scaled off more efficiently. Therefore, the image history can be effectively erased.

Further, when the wire member has an insulating layer on its surface, the wire member is electrically insulated from the developing agent carrier to effectively generate a dielectric potential to thereby make it possible to cause vibration efficiently.

In the above one-component developing apparatus according to the one aspect of the present invention, preferably, a bias voltage is applied between the developing agent scale-off member constituted by the wire member provided so as to be in contact with or in close proximity to the surface of the developing agent carrier. Accordingly, an electric field is generated between the developing agent scale-off member and the surface of the developing agent carrier so that a developing agent on the surface of the developing agent carrier is charged to thereby make it possible to generate disturbance and scale-off the developing agent by electric force. As a result, mechanical scale-off of the developing agent due to vibration of the wire member and scale-off of the developing agent due to the electric force are generated at the same time and the developing agent scaled off by the electric force urges the wire member in the direction of the normal line of the surface of the developing agent to increase self-vibration of the wire member to thereby generate a large effect in erasion of the image history. Further, when a bias voltage is applied between the developing agent carrier and the developing agent scale-off member, scale-off due to electric force is generated even in the case where the developing agent scale-off member is separated from the developing agent carrier by about 0.1 mm, so that the effect of erasure of the image history can be produced.

In the above one-component developing apparatus according to the other aspect of the present invention, preferably, the developing agent scale-off member constituted by a film member having a plurality of holes is provided so as to be in contact with or in close proximity to the surface of the developing agent carrier, so that the developing agent scale-off member comes into contact with a developing agent adhering on the surface of the developing agent carrier to thereby scale off the developing agent. As a result, the image history is erased in the same manner as in the one-component developing apparatus according to the one aspect of the present invention.

Further, when the developing agent scale-off member is made of a conductive material, a dielectric potential is generated in the developing agent scale-off member in the same manner as in the one-component developing apparatus according to the one aspect of the present invention to thereby make the developing agent scale-off member vibrate in the direction of the normal line of the surface of the developing agent carrier so that a developing agent can be efficiently scaled off.

At this time, the developing agent scale-off member is hardly deformed in the circumferential direction of the developing agent carrier because the developing agent scale-off member is constituted by a film member. Therefore, even when the developing agent scale-off member contacts a developing agent adhering on the surface of the developing agent carrier, it is not excessively deformed or damaged.

In the above one-component developing apparatus according to the other aspect of the present invention, preferably, the developing agent scale-off member is constituted by a conductive member and a bias voltage is applied between the developing agent scale-off member and the developing agent carrier, so that an electric field is generated between the developing agent scale-off member and the developing agent carrier to thereby make it possible to electrically scale off a developing agent in the same manner as in the one-component developing apparatus according to the one aspect of the present invention.

DETAILED DESCRIPTION OF THE PREFERRED EMBODIMENTS

Figure 1A:
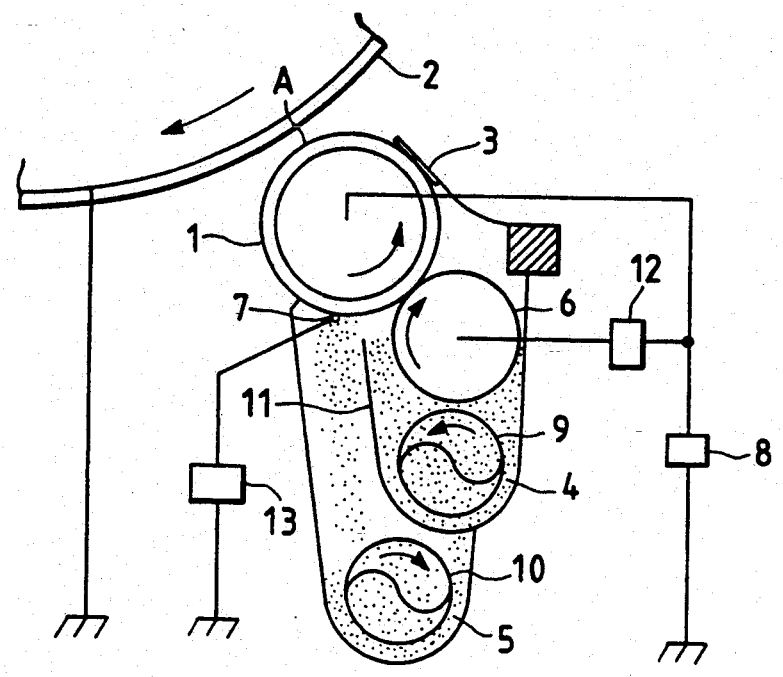
FIGS. 1*a* and 1*b* are schematic sectional views showing the configuration of the one-component developing apparatus which is a first embodiment of the present invention.

Referring to the drawings, embodiments of the one-component developing apparatus according to the present invention will be described hereunder.

Figure 1B:
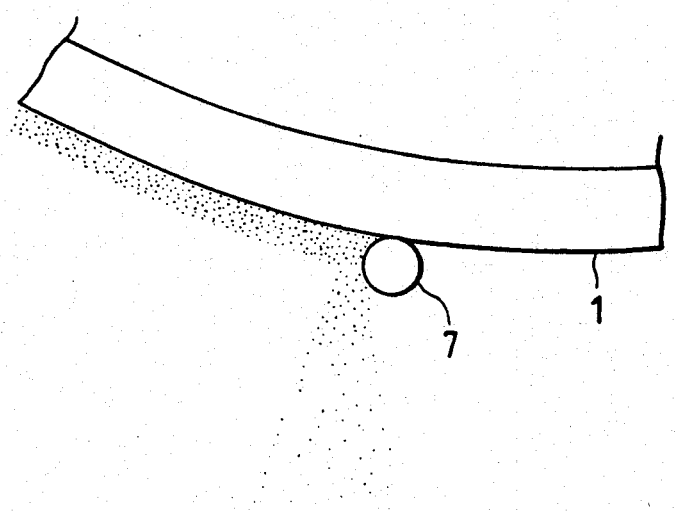

FIGS. 1*a* and 1*b* are schematic sections showing the configuration of the one-component developing apparatus which is a first embodiment of the present invention, shown as sections perpendicular to the direction of width of a picture to be developed.

The one-component developing apparatus is constituted by a cylindrical developing agent carrier 1 which rotates in opposition to an electrostatic latent image holder 2, a developing agent restriction member 3 for restricting the quantity of a developing agent to be put on the developing agent carrier 1 and for forming a thin layer of the developing agent, a first developing agent accommodation chamber 4 provided at a position adjacent to the developing agent carrier 1 so as to accommodate the developing agent fed from a developing agent storebox (not shown) provided outside the developing apparatus, a developing agent feed member 6 which is a roll rotating in close proximity to the developing agent carrier 1 so as to feed the developing agent from the first developing agent accommodation chamber 4 to the developing agent carrier 1, a second developing agent accommodation chamber 5 separated from the first developing agent accommodation chamber 4 through a partition 11, and a developing agent scale-off member 7 for scaling the developing agent thin film off of the developing agent carrier 1.

The developing agent carrier 1 rotates carrying the developing agent adhering to the surface thereof. The position where the developing agent carrier 1 is in close proximity to the electrostatic latent image holder 2 having a surface holding an electrostatic latent image thereon forms a developing region A. The developing agent carrier 1 has a diameter of about 5–40 mm and rotates at a speed of about 100–300 rpm. The developing agent carrier 1 is formed in a manner such that a rod or pipe of aluminum or stainless steel is subjected to cutting work, a semiconductive layer of phenol resin or the like is formed on the circumferential surface of the worked rod or pipe, and the semiconductive layer is subjected to mechanical grinding, such as emery grinding or the like, so as to have a surface roughness Ra of about 0.1–1.0 μm. The volume resistivity of the phenol resin in the direction of thickness is made to be about $10^5$–$10^{12}$ Ωm.

Alternatively, the developing agent carrier 1 may be produced in a manner such so that after a rod or pipe of aluminum or stainless steel is subjected to cutting work, the circumferential surface of the worked rod or pipe is subjected to mechanical grinding, such as sandblasting, liquid honing, emery grinding or the like, or chemical corrosion, so as to form surface unevenness with Ra of about 0.1–1.0 μm.

Further, a DC superimposed AC voltage is applied, from a developing bias power source 8, to the developing agent carrier 1, so that the developing agent having charges is made to adhere to the electrostatic latent image by an electric field formed at the position A (development region) in close proximity to the electrostatic latent image holder 2.

The developing agent restriction member 3 is formed in a manner so that Si rubber or EPDM rubber is vulcanizing-bonded to a stainless steel plate spring having a thickness of about 0.03–0.3 mm. The developing agent restriction member 3 is set so as to have contact pressure against the developing agent carrier 1 of about 20–200 g/cm to thereby form the developing agent into a thin film of about 5–30 μm and to give the thin film charges of about 2–20 C/g.

A developing agent feed auger 9 and a developing agent collection auger 10 are provided in the first and second developing agent accommodation chambers 4 and 5 respectively. The developing agent feed auger 9 carries the developing agent from the first developing agent accommodation chamber 4 and feeds the developing agent to the developing agent feed member 6. The developing agent collection auger 10 collects the developing agent in the second developing agent accommodation chamber 5 and returns the developing agent to the first developing agent accommodation chamber 4.

The developing agent feed auger 9 is formed in a manner that a spiral auger having a radial width of about 4 mm is bonded around a stainless steel shaft of 6 mm so that the pitch changes stepwise to be 20, 10, and 5.5 mm. The toner collection auger 10 is formed in a manner so that a spiral auger having a radial width of about 4 mm is bonded around a stainless steel shaft of 6 mm with a pitch of 20 mm.

The partition 11 between the first developing agent accommodation chamber 4 and the second developing agent accommodation chamber 5 is opened at its upper portion, so that when the quantity of developing agent fed into the first developing agent accommodation chamber 4 is too much, the developing agent is flowed over the partition 11 so as to be discharged into the second developing agent accommodation chamber 5.

The developing agent feed member 6 is a cylindrical molding product which has a diameter of about 10–20 mm and is made of urethane foam or the like, and which comes into contact with the developing agent carrier 1 to thereby rotate at a peripheral velocity of about 1–4 times of that of the developing agent carrier 1.

Further, in order to improve the feeding rate of the developing agent, a bias voltage is applied, from a bias power source 12 for the developing agent feed member, between the developing agent feed member 6 and the developing agent carrier 1. For the application of the bias voltage to the developing agent feed member, the developing agent feed member is made of urethane containing carbon so as to have a volume resistivity of about $10^4$–$10^9$ μcm.

The developing agent feed member may be made to have a shape in which a continuous vane is radially provided on a rotary shaft at its axial circumference, other than the cylindrical shape.

Further, alternatively, the arrangement may be made so that no bias voltage is applied between the developing agent holder and the developing agent feed member.

A glass coated tungsten wire having a diameter of about 300 μm is employed as the developing agent scale-off member 7. Holes each having a diameter slightly larger than that of the wire are formed in opposite side frames of the developing apparatus respectively, and the wire is stretched between the holes with an interval at which the wire is in contact with the surface of the developing agent carrier or in contact with the developing agent thin layer.

A peak to peak voltage of about 300–1500 V and an AC bias voltage of 50 Hz–15 kHz (preferably 2000–5000 Hz) are applied, from a bias power source 13 for the developing agent scale-off member, to the tungsten wire.

As the developing agent to be used in the developing apparatus as described above, the following is desirable.

A desirable developing agent is a non-magnetic or magnetic one-component developing agent, in which a polarity control agent, for example, a pigment such as carbon or the like, or metal-containing azo dye or the like, is dispersed in various thermoplastic resin such as styrene resin, an acryl resin, or the like, is ground, and is classified so as to have a size of 5–20 μm. Further a charge control agent is externally added to the developing agent. As the charge control agent, fine particles of not larger than 0.1 μm of hydrophobically-treated silica, alumina, titanium, or the like, may be used, the hydro phobic silica being the most preferable.

In such an one-component developing apparatus, the developing agent fed from the developing agent storebox (not shown) provided outside the developing apparatus is accumulated in the first developing agent accommodation chamber 4. Of the accumulated developing agent, the portion accumulated higher than the partition 11 between the first and second developing agent accommodation chambers 4 and 5 overflows so as to be carried into the second developing agent accommodation chamber 5. Accordingly, the developing agent having a fixed quantity is stored in the first developing agent accommodation chamber 4.

The developing agent feed member 6 feeds the developing agent, from the first developing agent accommodation chamber 4, to the developing agent carrier 1. The developing agent restriction member 3 gives sufficient charges to the developing agent fed on the surface of the developing agent carrier 1 and makes the developing agent into a thin layer. The developing agent carrier 1 rotates so as to carry the thin layer of the developing agent to the developing region A where the developing agent is transferred to the opposite electrostatic latent image holder 2 by the oscillating electric field generated in the developing region A to thereby develop the electrostatic latent image.

The electrostatic latent image holder 2 rotates in the direction opposite to that of the developing agent carrier 1 as shown in FIG. 1*a*. When the electrostatic latent image holder 2 has no latent image in opposition to the developing agent carrier 1, the thin layer of developing agent carrier 1 passes through the development region A as it is adhering to the developing agent carrier surface without contributing to development.

The thin layer of the developing agent comes into contact with the developing agent scale-off member 7 made of the wire member and stretched so as to come into contact with or into close proximity to the surface of the developing agent holder as shown FIG. 1*b*, so that the thin layer is forcibly scaled off to thereby fall into the second developing agent accommodation chamber 5.

The wire member is made of a tungsten wire, and the surface of the wire is coated with glass forming an insulating layer, so that self-vibration is caused in the normal direction of the developing agent carrier surface by the DC superimposed AC voltage applied to the developing agent carrier 1. Accordingly, the developing agent can be efficiently scaled off by the vibration.

Further, the bias voltage is applied between the wire member and the developing agent carrier, so that an electric field is generated between the wire member and the developing agent carrier to promote scaling-off of the developing agent by the action of the electric force.

A new developing agent is fed, by the developing agent feed member 6, onto the developing agent carrier from which the thin layer of the developing agent has been scaled off, so that a new thin layer is evenly formed to cover the portions where the developing agent in the form of the thin layer has been consumed and not consumed respectively in the previous developing. Accordingly, image history is erased to make it possible form a preferable to image.

On the other hand, the developing agent which has fallen into the second developing agent accommodation chamber 5 is returned to the first developing agent accommodation chamber 4 by means of the developing agent collection auger 5.

In order to confirm the aging stability of such a developing process as described above, a long-time development test was conducted so that development was continuously performed 30,000 times by the one-component developing apparatus of the embodiment described above. As a result, no image defect due to the image history was recognized, and a good result was obtained.

Figure 2:
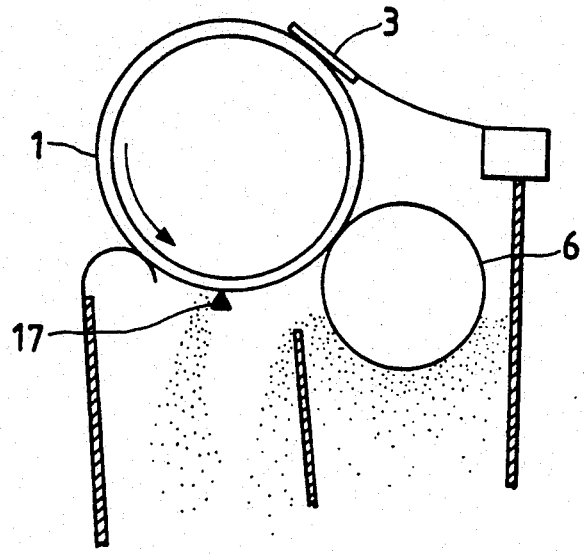
FIG. 2 is a schematic sectional view showing the configuration of the one-component developing apparatus which is a second embodiment of the present invention.
Figure 3:
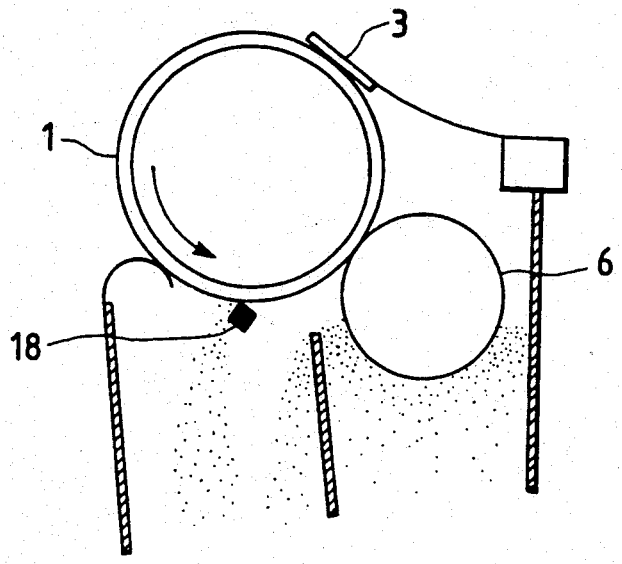
FIG. 3 is a schematic sectional view showing the configuration of the one-component developing apparatus which is a third embodiment of the present invention.

FIGS. 2 and 3 show second and third embodiments of the present invention respectively. FIG. 2 is a schematic section in which a wire member of a developing agent scale-off member is triangular in section, while FIG. 4 is a schematic section in which a wire member of a developing agent scale-off member is square.

A wire member 17 having such a triangular section or a wire member 18 having such a square section may be made of stainless steel or the like. When an acute angle portion of each of the sections is selected to come into close vicinity to the surface of a developing agent carrier 1, even if the sectional area is made larger than that in the case where the wire member having the circular section is used, the same effect can be obtained. As the sectional area is made large, there are advantages that the attachment of the wire member is made easy, and that troubles such as the loss of function, etc. due to disconnection can be prevented.

FIG. 4 is a schematic section showing the one-component developing apparatus which is a fourth embodiment of the present invention.

Figure 4A:
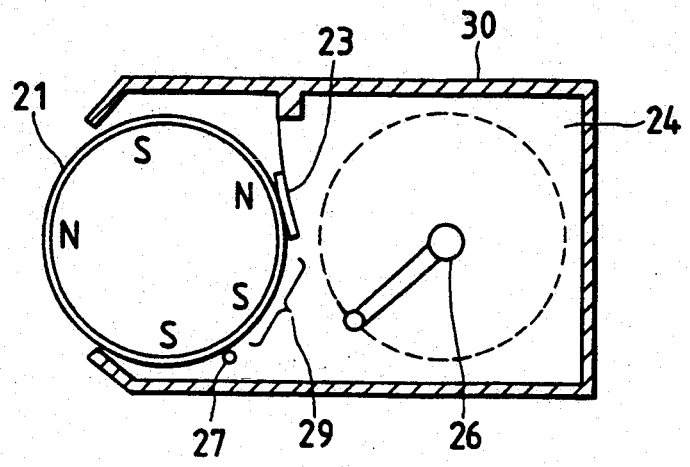
FIGS. 4*a*, 4*b* and 4*c* are schematic diagrams showing the configuration of the one-component developing apparatus which is a fourth embodiment of the present invention.

The one-component developing apparatus uses a magnetic one-component developing agent. As shown in FIG. 4*a*, in a housing, there are provided a cylindrical developing agent carrier 21 which has a plurality of magnets incorporated therein and fixed in position so that the cylindrical developing agent carrier 21 rotates while absorbing a developing agent; a developing agent restriction member 23 for restricting the quantity of developing agent on the developing agent carrier and for forming a thin layer of the developing agent; a developing agent stirring and feed member 26 provided in a developing agent accommodation chamber 24 in the rear of the developing agent carrier 21 so as to stir the developing agent and feed the stirred developing agent to the developing agent carrier 21; and a developing agent scale-off member 27 made of a wire member and provided upstream of a developing agent feed member 29 in the direction of the rotation of the developing agent carrier 21.

Figure 4B:
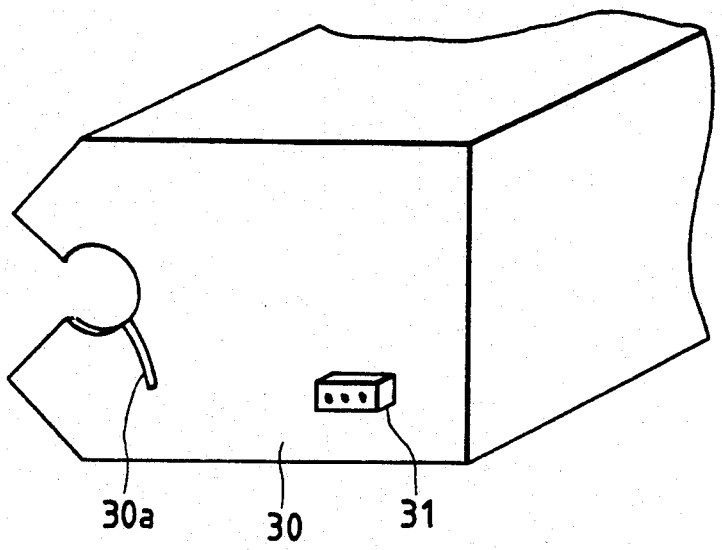
Figure 4C:
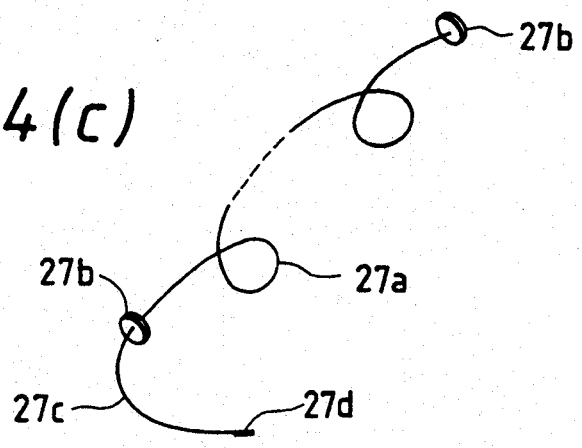

As shown in FIG. 4*c*, in the developing agent scale-off member 27, engagement locking pieces 27*b* are bonded to a wire member 27*a* at its opposite ends respectively, one of the ends being connected to a bias voltage application cord 27*c*. In the condition in which tension is applied, the wire member is penetrated into notches 30*a* formed in the housing 30 at its side surfaces respectively as shown in FIG. 4*b*, and the engagement locking pieces 27*b* are made to abut against the outer surfaces of the housing side plates so as to be locked.

A connector pin 27*d* is attached to a top end of the cord 27*c* connected to the wire member 27*a* so that the connector pin 27*d* can be connected to a connector 31 provided on an outer surface of the housing 30. The connector 31 is connected to a power source (not shown) for the application of a bias voltage, so that the bias voltage can be applied between the developing agent scale-off member 27 and the developing agent carrier 21.

The wire member is laid between the plural magnetic poles provided inside the developing agent carrier 21 as shown in FIG. 4*a*, so that the wire member comes into contact with the developing agent at the position where the magnetic force for absorbing the developing agent on the surface of the developing agent carrier 21 is small. Accordingly, the developing agent can be efficiently scaled off from the surface of the developing agent carrier 21. It is most desirable that the wire member is provided between the magnetic poles having the same polarity. The wire member may be, however, provided between the magnetic poles having polarities different from each other.

This one-component developing apparatus can be made small in size resulting in reduced size of the overall image forming apparatus, and the defect of image due to the image history can be prevented similarly to the first embodiment.

Figure 5A:
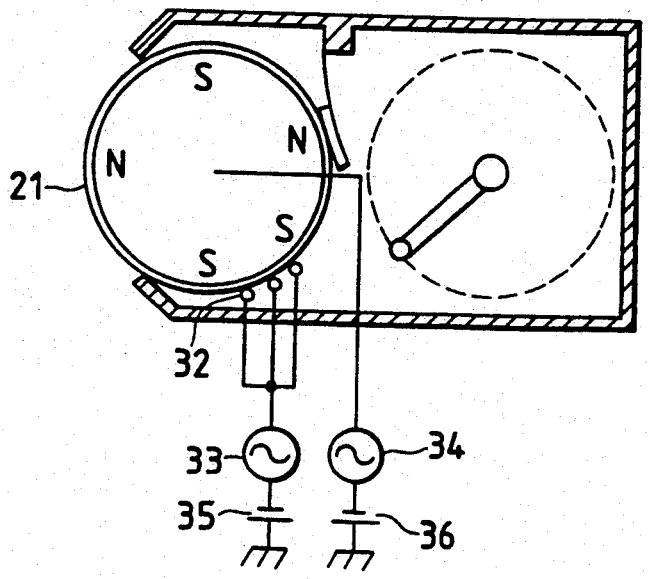
FIGS. 5*a* and 5*b* are schematic sectional views showing the configurations of one-component developing apparatus which are fifth and sixth embodiments of the present invention.

FIG. 5*a* is a schematic view showing the one-component developing apparatus which is a fifth embodiment of the present invention. The one-component developing apparatus has a developing agent scale-off member 32 in which a plurality of wire members parallel to the axial direction of a developing agent carrier 21 and parallel to each other are laid so as to come into contact with the source of the developing agent carrier 21.

Bias voltages are applied to the developing agent scale-off member 32 and the developing agent carrier 21 from AC power sources 33 and 34 and DC power sources 35 and 36 respectively. A DC superimposed AC voltage having a frequency of 2.4 KHz, a peak to peak voltage of 2000 V, and a DC components of 300 V is applied to the developing agent carrier 21. A DC superimposed AC voltage having a frequency of 12 KHz, a peak to peak voltage of 1000 V, and a DC component of 300 V is applied to the developing agent scale-off member 32. Accordingly, a bias voltage corresponding to the AC component is produced between the developing agent scale-off member 32 and the developing agent carrier 21.

In such a developing apparatus, the developing agent scale-off member 32 is constituted by a plurality of parallel wire members, so that each wire member comes into contact with the developing agent on the developing agent carrier so as to scale off the developing agent, and an electrolytic action is produced in a wide region. Accordingly, the developing agent can be effectively scaled off.

Figure 5B:
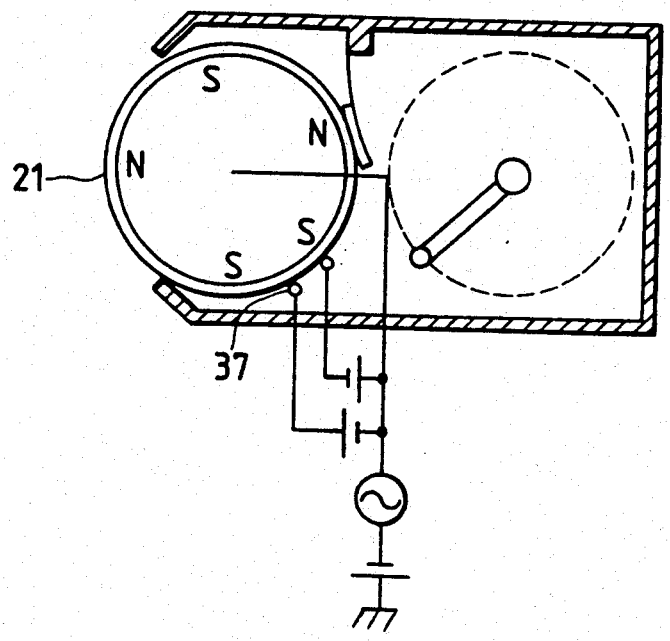

FIG. 5*b* shows the one-component developing apparatus which is a sixth embodiment of the present invention. Similarly to the embodiment shown in FIG. 5*a*, the one-component developing apparatus has a developing agent scale-off member 37 constituted by a plurality of wire members. In this one-component developing apparatus, however, a bias voltage is applied between the developing agent scale-off member 37 and a developing agent carrier 21 so that the polarities of certain wire members and other ones are opposite to each other. Although only a DC voltage is applied between the developing agent scale-off member 37 and the developing agent carrier 21 in FIG. 5B, an AC component may be superimposed on the DC voltage.

In such an one-component developing apparatus, it is possible to effectively scale off a developing agent which adheres to the surface of the developing agent carrier after the developing agent passes through the development region and which has a reverse polarity of charges.

Figure 6A:
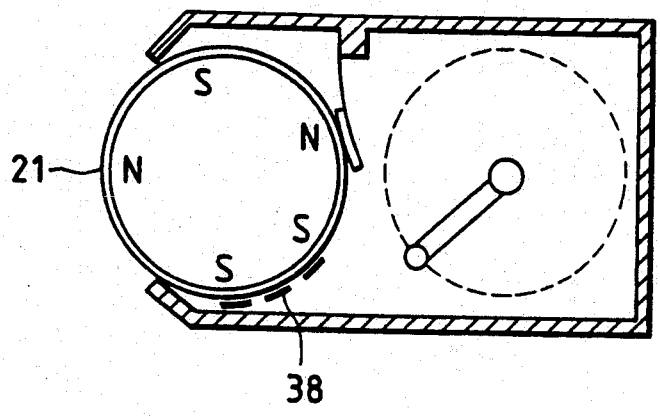
FIGS. 6*a* and 6*b* are a schematic sectional view and a partial outline view showing the configuration of the one-component developing apparatus which is another embodiment of the present invention.
Figure 6B:
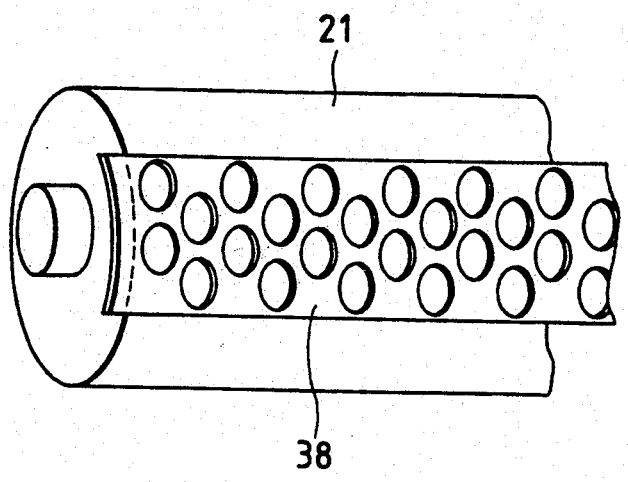
Figure 7A:
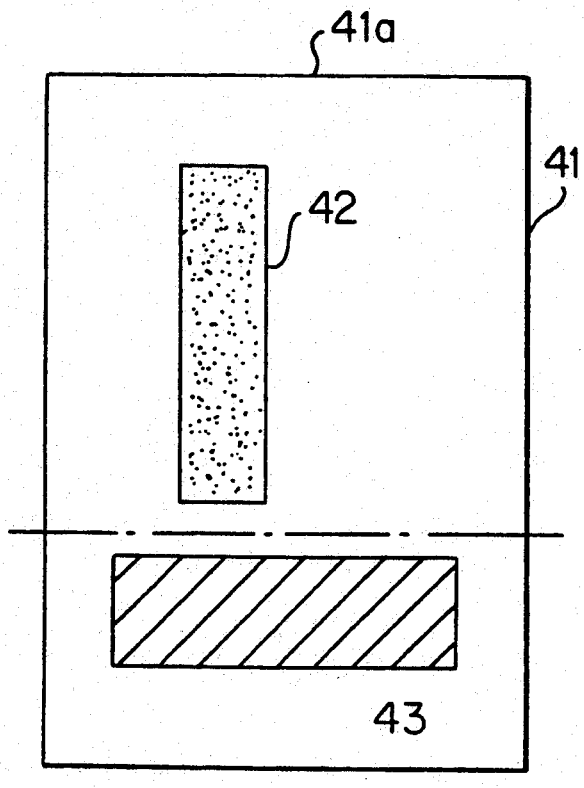
FIG. 7(a) PRIOR ART
FIGS. 7*a* and 7*b* are diagrams for explaining an image fault which may be sometimes generated in the conventional one-component developing apparatus.
Figure 7B:
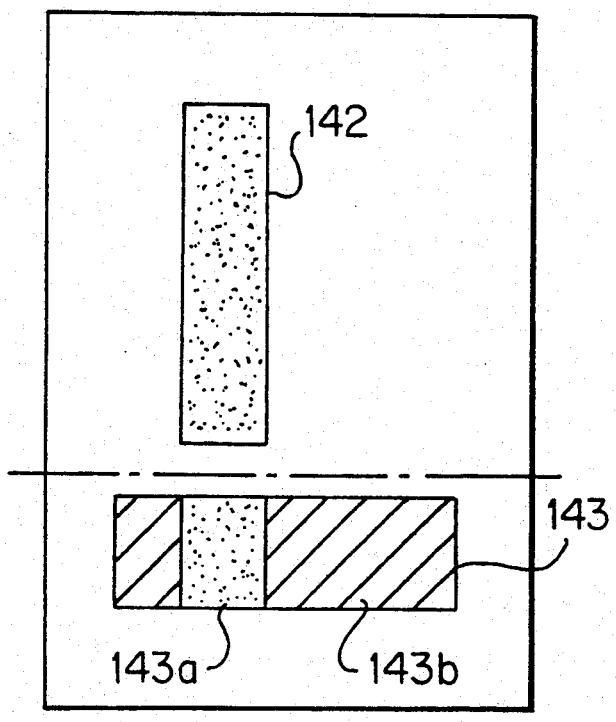
FIG. 7(b) PRIOR ART
Figure 8:
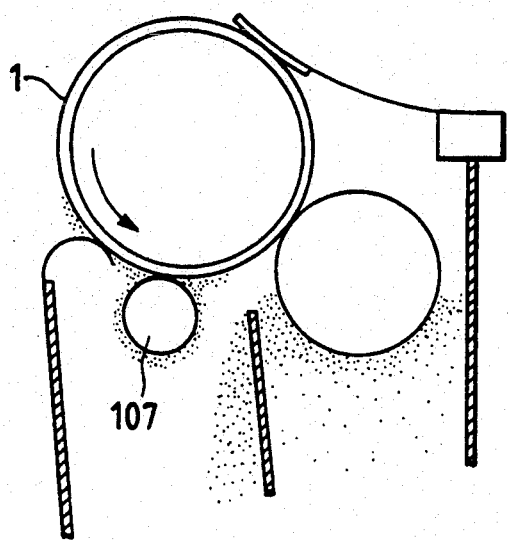
FIG. 8 PRIOR ART
FIG. 8 is a schematic sectional view showing the configuration of an example of the conventional one-component developing apparatus.
Figure 9:
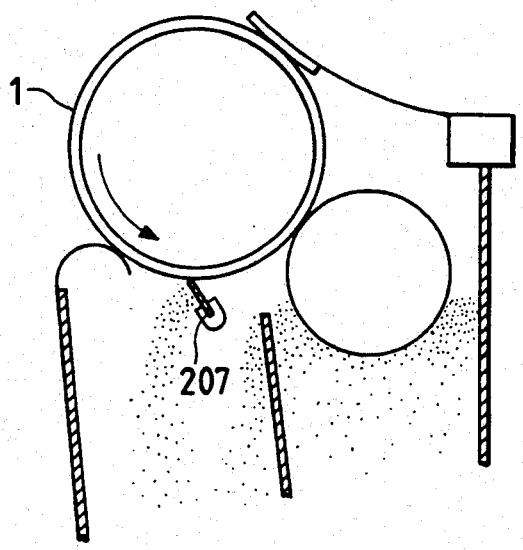
FIG. 9 PRIOR ART
FIG. 9 is a schematic sectional view showing the configuration of another example of the conventional one-component developing apparatus.

FIG. 6*a* is a schematic section showing the one-component developing apparatus which is another embodiment of the present invention, and FIG. 6*b* is a partial external view of a developing agent carrier and a developing agent scale-off portion.

In this one-component developing apparatus, as shown in FIG. 6*b*, a developing agent scale-off member 38 is a thin plate which is made of a conductive material, in which many circular holes are formed, and which is provided parallel to the axial direction of a developing agent carrier 21 so as to come into contact with the surface of the developing agent carrier 21.

Also in such a developing apparatus, the developing agent scale-off member 38 comes into contact with the developing agent on the surface of the developing agent carrier 21 so as to scale off the developing agent. The developing agent scale-off member 38 is made to vibrate in the normal direction of the surface of the developing agent carrier by an AC bias voltage applied to the developing agent carrier 21, so that the developing agent can be efficiently scaled off.

In that time, since the developing agent scale-off member 38 is made of a film-like member, the developing agent scale-off member 38 can freely vibrate in the normal direction of the surface of the developing agent carrier, and even if the developing agent scale-off member 38 comes into contact with the developing agent, of the developing agent carrier surface, the structural strength in the circumferential direction is so large that the developing agent scale-off member 38 is hardly deformed or damaged.

Further, a bias voltage may be applied between the developing agent scale-off member 38 and the developing agent carrier 21 so that scaling off of the developing agent from the developing agent carrier 21 can be produced by the electrical operation at the same time.

As described above, the one-component developing apparatus according to the present invention has a wire member or a film-like member which is laid in contact with or in close proximity to the surface of the developing agent carrier, so that the developing apparatus is simple in structure, inexpensive in manufacturing cost, and not large in size, and a so-called ghost due to the image history can be prevented from occurring so as to obtain a good image.

Further, when a conductive material is used as the wire member or the film-like member of the developing agent scale-off member, the wire member or the film-like member is made to self-vibrate by the AC bias voltage applied to the developing agent carrier, so that the thin layer of the developing agent on the surface of the developing agent carrier is efficiently scaled off and the image history is erased. Further, when a bias voltage is applied between the developing agent scale-off member and the developing agent carrier, the developing agent can be scaled off not only mechanically but electrically, so that the developing agent is more efficiently scaled off so as to erase the image history.

What is claimed is:

1. A one-component developing apparatus comprising:

a developing agent carrier;

a electrostatic latent image holder, disposed opposite to said developing agent carrier;

means for feeding developing agent to said developing agent carrier;

means for forming a thin layer of said developing agent on a surface of said developing agent carrier by restricting the thickness of said developing agent adhering to said surface;

means for transferring said developing agent carried by said developing agent carrier to said electrostatic latent image holder to develop an electrostatic latent image on said electrostatic latent image holder, said transferring means including means for generating an alternating electric field between said developing agent carrier and said electrostatic latent image holder; and developing agent scaling means for removing developing agent from said developing agent carrier, said scaling means including at least one conductive wire member oriented parallel to said surface of said developing agent carrier, at a distance enabling said wire member to contact said thin layer of said developing agent, and at a position between a first point at which said developing agent carrier is substantially close to said electrostatic latent image holder and a second point at which said developing agent feeding means is positioned and downstream relative to the direction of movement of said surface of said developing agent carrier, wherein said conductive wire member vibrates in response to an electric field such that said developing agent is scaled from the developing agent carrier by vibration of said conductive wire member.

2. The one-component developing apparatus of claim 1, wherein said developing agent scaling means further includes means for applying a bias voltage between said at least one conductive wire member and said developing agent carrier to produce said electric field.

3. The one-component developing apparatus of claim 2, wherein said distance at which said at least one conductive wire member is oriented enables said conductive wire member to contact said surface of said developing agent carrier.

4. The one-component developing apparatus of claim 1, wherein said electric field is produced by said means for generating an alternating electric field between said developing agent carrier and said electrostatic latent image holder.

5. The one-component developing apparatus of claim 4, wherein said distance at which said at least one conductive wire member is oriented enables said conductive wire member to contact said surface of said developing agent carrier.

6. The one-component developing apparatus of claim 1, wherein said distance at which said at least one conductive wire member is oriented enables said conductive wire member to contact said surface of said developing agent carrier.

7. A one-component developing apparatus comprising:

a developing agent carrier;

an electrostatic latent image holder, disposed opposite to said developing agent carrier;

means for feeding developing agent to said developing agent carrier;

means for forming a thin layer of said developing agent on a surface of said developing agent carrier by restricting a thickness of said developing agent adhering to said surface;

means for transferring said developing agent carried by said developing agent carrier to said electrostatic latent image holder to develop an electrostatic latent image on said electrostatic latent image holder, said transferring means including means for generating an alternating electric field between said developing agent carrier and said electrostatic latent image holder; and developing agent scaling means for removing developing agent adhering to portions of said developing agent carrier, said scaling means including at least one conductive film-like member having a plurality of holes, said conductive film-like member being oriented parallel to said surface of said developing agent carrier, at a distance enabling said conductive film-like member to contact said thin layer of said developing agent, and at a position between a first point at which said developing agent carrier is substantially close to said electrostatic latent image holder and a second point at which said developing agent feeding means is provided and downstream relative to the direction of movement of said surface of said developing agent carrier, wherein said conductive film-like member vibrates in response to an electric field such that said developing agent is scaled from said developing agent carrier by vibration of said conductive film-like member.

8. The one-component developing apparatus of claim 7, further comprising means for applying a bias voltage between said conductive film-like member and said developing agent carrier to produce said electric field.

9. The one-component developing apparatus of claim 8, wherein said distance at which said at least one conductive film-like member is oriented enables said conductive film-like member to contact said surface of said developing agent carrier.

10. The one-component developing apparatus of claim 7, wherein said electric field is produced by said means for generating an alternating electric field between said developing agent carrier and said electrostatic latent image holder.

11. The one-component developing apparatus of claim 10, wherein said distance at which said at least one conductive film-like member is oriented enables said conductive film-like member to contact said surface of said developing agent carrier.

12. The one-component developing apparatus of claim 7, wherein said distance at which said conductive film-like member is oriented enables said conductive film-like member to contact said surface of said developing agent carrier.

13. A one-component developing apparatus comprising:

a developing agent carrier;

an electrostatic latent image holder, disposed opposite to said developing agent carrier;

means for restricting a thickness of said developing agent adhering to a surface of said developing agent carrier to form a thin layer of said developing agent on said surface;

means for transferring said developing agent carried by said developing agent carrier to said electrostatic latent image holder to develop an electrostatic latent image on said electrostatic latent image holder, said transferring means including means for generating an electric field between said developing agent carrier and said electrostatic latent image holder; and developing agent scaling means for removing developing agent adhering to portions of said developing agent carrier, said scaling means including at least one conductive wire member oriented parallel to said surface of said developing agent carrier at a distance enabling said wire member to contact said thin layer of said developing agent, wherein said conductive wire member vibrates in response to an electric field such that said developing agent is scaled from said developing agent carrier by vibration of said conductive wire member.

14. A one-component developing apparatus comprising:

a developing agent carrier;

an electrostatic latent image holder, disposed opposite to said developing agent carrier;

means for restricting a thickness of said developing agent adhering to said surface of said developing agent carrier to form a thin layer of said developing agent on said surface;

means for transferring said developing agent carried by said developing agent carrier to said electrostatic latent image holder to develop an electrostatic latent image on said electrostatic latent image holder, said transferring means including means for generating an alternating electric field between said developing agent carrier and said electrostatic latent image holder; and developing agent scaling means for removing developing agent adhering to portions of said developing agent carrier, said scaling means including at least one conductive film-like member having a plurality of holes, said conductive film-like member being oriented parallel to said surface of said developing agent carrier at a distance enabling said film-like member to contact said thin layer of said developing agent, wherein said conductive film-like member vibrates in response to an electric field such that said developing agent is scaled from said developing agent carrier by vibration of said conductive film-like member.

* * * * *